US007806551B1

(12) United States Patent
Phipps

(10) Patent No.: US 7,806,551 B1
(45) Date of Patent: Oct. 5, 2010

(54) HALLOWEEN TRICK BOWL

(76) Inventor: Jackson River Phipps, 328 Gifford Dr., Coppell, TX (US) 75019

( * ) Notice: Subject to any disclaimer, the term of this patent is extended or adjusted under 35 U.S.C. 154(b) by 211 days.

(21) Appl. No.: 12/276,563

(22) Filed: Nov. 24, 2008

Related U.S. Application Data

(63) Continuation-in-part of application No. 11/464,616, filed on Aug. 15, 2006, now abandoned.

(51) Int. Cl.
*F21V 33/00* (2006.01)

(52) U.S. Cl. ..... 362/154; 362/253; 362/802; 362/806; 220/2.1 R; 220/203.01; 220/229; 220/914; 472/40; 472/71; 472/137

(58) Field of Classification Search ..... 362/154, 362/189, 253, 458, 802, 806; 220/2.1 R, 220/203.01, 229, 914; 472/40, 71, 137
See application file for complete search history.

(56) References Cited

U.S. PATENT DOCUMENTS 2,471,676 A * 5/1949 Enochs ..... 472/71
4,328,904 A * 5/1982 Iverson ..... 220/229
2004/0201982 A1 * 10/2004 Backes et al. ..... 362/154

* cited by examiner

*Primary Examiner*—Sandra L O'Shea
*Assistant Examiner*—Meghan K Dunwiddie

(57) ABSTRACT

An apparatus comprising a bowl having an opening. The opening includes a plurality of movable members movable between a first position and a second position. The first position is a closed position in which the movable members are connected and support items in the bowl. The second position is an open position and allows a hand to enter the opening. The apparatus includes a circuit that includes a switch operably connected to said moveable members such that a light turns on upon said moveable members being in a second position.

4 Claims, 2 Drawing Sheets

HALLOWEEN TRICK BOWL

RELATED APPLICATIONS

This application claims the benefit of U.S. patent application Ser. No. 11/464,616 filed Aug. 15, 2006, and entitled "Halloween Trick Bowl".

FIELD OF THE INVENTION

The present invention relates generally to a novel bowl. More particularly, the present invention relates to a bowl having an opening.

PRIOR ART

Bowls have been used for centuries to hold items.

SUMMARY OF THE INVENTION

The present invention is a bowl having an opening through which a hand may be placed. One application of the invention is a Halloween bowl for holding candy. A hand of the user can enter the hole in the bowl and grab the hand of a trick-or-treater to surprise said individual.

DETAILED DESCRIPTION

Figure 1:
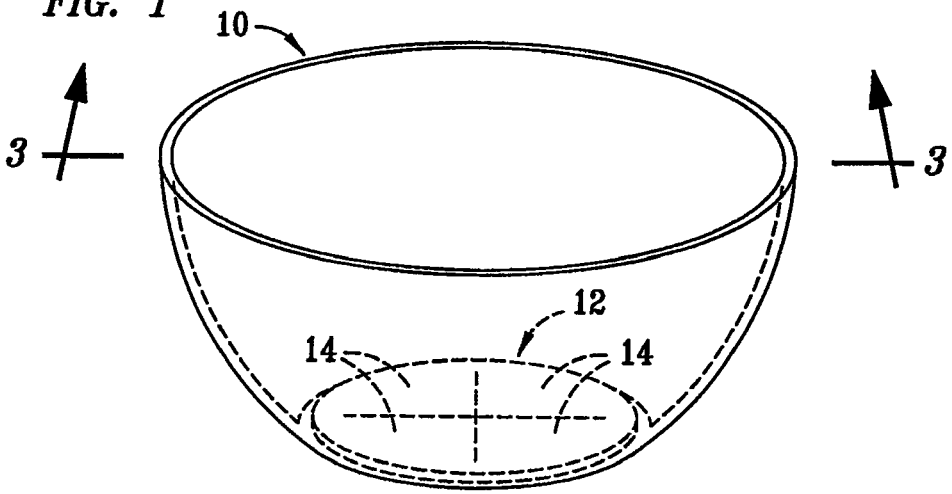
FIG. 1 is a depiction of a side view of the bowl of the present invention.
Figure 2:
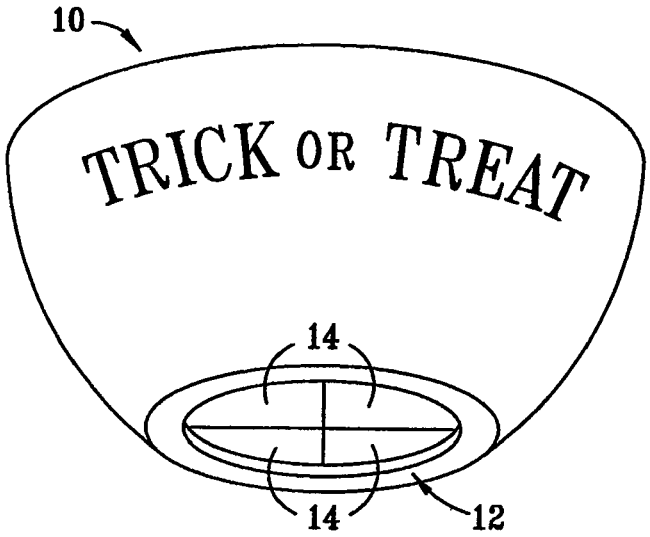
FIG. 2 is a depiction of a side view of the bowl of the present invention.
Figure 3:
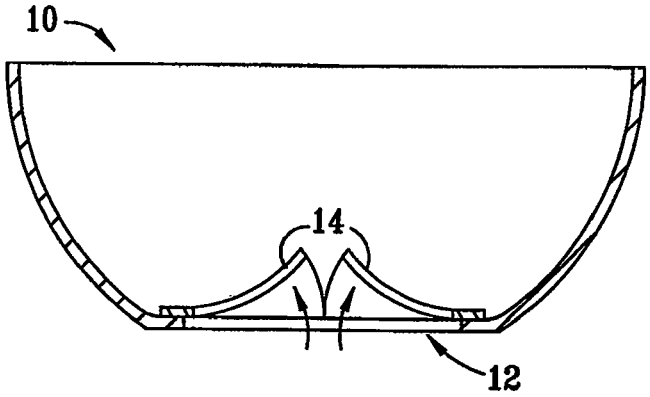
FIG. 3 is a depiction of the bowl of the present invention wherein the movable members are in an open position.

The present invention is a bowl 10 having an opening 12. Opening 12 includes a plurality of movable members 14. Movable members 14 can be connected in a first position so as to support items (e.g., candy) placed in bowl 10. Movable members 14 can also be displaced into a second position shown in FIG. 3 to allow a hand (not part of the invention but supplied by a user) to enter bowl 10. The entering hand can push the items out of the bowl and or grab the hand of another person who is reaching into bowl 10 to retrieve an item.

A method of using the present invention involves placing items in bowl 10 while opening 12 is closed by means of movable members 14; thereafter placing the bowl 10 in the area of another and waiting for said other to retrieve an item from the bowl; then at an appropriate moment to place a hand through the opening 12, displace movable members 14, and startle the item retriever.

Figure 4:
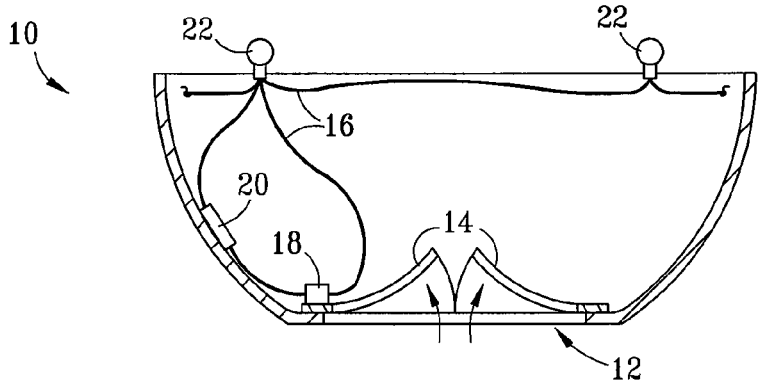
FIG. 4 is a depiction of the bowl of the present invention wherein the bowl includes a circuit operably connected to the movable members.
Figure 5:
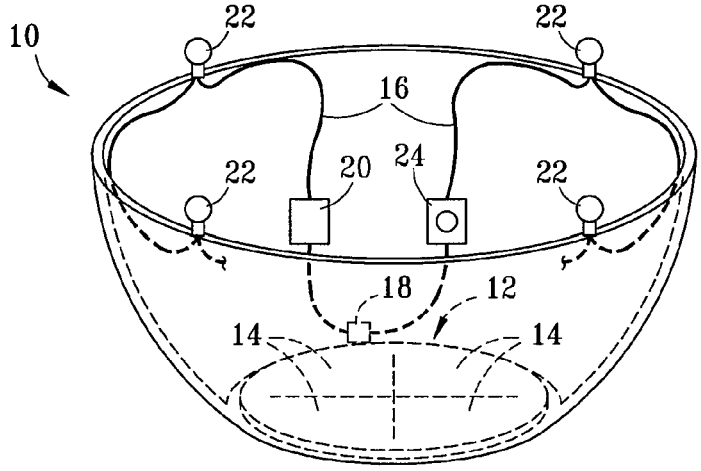
FIG. 5 is a depiction of the bowl of the present invention wherein the bowl includes a circuit operably connected to characters.

As shown in FIG. 4, the invention further includes a circuit 16 that includes a switch 18. Circuit 16 includes a power source 20. Power source 20 can includes batteries. Switch 18 is operably connected to movable members 14 such that when a hand passes through opening 12, switch 18 is engaged and current passes through circuit 16. Circuit 16 may further include one or more lights 22, as shown in FIG. 4. As shown in FIG. 5, circuit 16 may further include spring activated characters 24. Spring activated characters 24 may be located on the rim of the bowl 10 or within the interior of bowl 10. When the characters 24 are disposed within the interior of bowl 10, the characters 24 may be disposed below the level of candy placed in the bowl so that a user would not notice the characters upon inspection.

Figure 6:
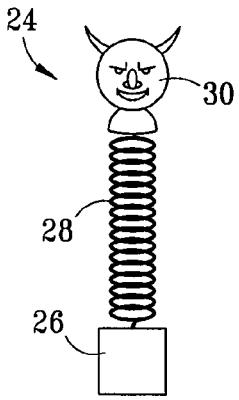
FIG. 6 is a depiction of the characters used in the bowl of the present invention wherein the characters are operated by the circuit.

As shown in FIG. 6, characters 24 include a base 26, a spring 28 and a depiction (e.g. face, monster) 30.

Figure 7:
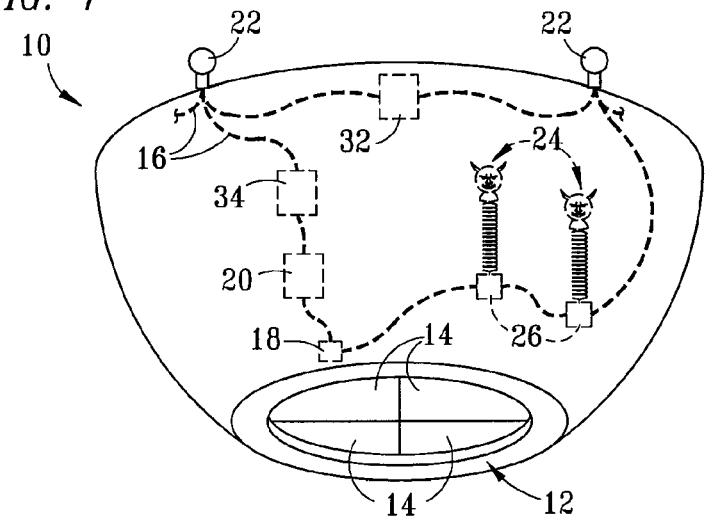
FIG. 7 is a depiction of the bowl of the present invention wherein the bowl includes a circuit operably connected to a motion sensor.

As shown in FIG. 7, circuit 16 can include a motion sensor 32 that operates as a switch to activate one or more of the characters 24 and/or lights 22. In addition, a sound recording and speaker 34 can be connected to circuit 16 and operated by means of motion sensor 32 and or switch 18.

I claim:

1. An apparatus comprising:

a bowl having an opening;

said opening including a plurality of movable members;

said movable members being movable between a first position and a second position;

wherein said movable members in said first position can support items in said bowl and wherein said movable members in said second position can allow for passage of a hand into said bowl through said opening;

a switch connected to said movable members;

a circuit connected to said switch that includes at least one light;

wherein said switch is operably connected to said movable members such that when said moveable members are in said second position, said switch allows current to flow through said circuit such that said light turns on.

2. The apparatus of claim 1 wherein said bowl further comprises:

a spring-activated character connected to said circuit wherein said character springs up when said moveable members are in said second position such that said circuit activates said character.

3. The apparatus of claim 1 wherein said bowl further comprises:

a sound recording and speaker connected to said circuit.

4. The apparatus of claim 1 wherein said bowl further comprises:

A motion sensor switch connected to said circuit.

* * * * *